United States Patent [19]

Gaeth et al.

[11] 3,940,535

[45] Feb. 24, 1976

[54] REVERSIBLE MOISTURE-VAPOR-ABSORPTIVE SHEET STRUCTURES AND PROCESS

[75] Inventors: Rudolf Gaeth, Limburgerhof; Roland Linke, Weinheim, both of Germany

[73] Assignee: BASF Aktiengesellschaft, Ludwigshafen (Rhine), Germany

[22] Filed: Nov. 21, 1973

[21] Appl. No.: 418,068

[30] Foreign Application Priority Data

Nov. 23, 1972 Germany ..... 2257393

[52] U.S. Cl. ..... 428/260; 427/44; 427/246; 427/390; 428/390; 428/500

[51] Int. Cl.[2] ..... D03D 25/00; D04H 13/00

[58] Field of Search ..... 117/62, 161 UZ, 140 A, 117/143 A, 145, 93.31; 428/260, 290, 500; 427/44, 390, 246

[56] References Cited

UNITED STATES PATENTS

| | | | |
|---|---|---|---|
| 3,352,710 | 11/1967 | Wolf et al. | 117/140 A |
| 3,684,562 | 8/1972 | Pascall | 117/161 UZ |
| 3,705,053 | 12/1972 | Emmons | 117/161 UZ |
| 3,720,562 | 3/1973 | Drelich | 117/161 UZ |
| 3,753,826 | 8/1973 | Plummer | 117/140 A |

*Primary Examiner*—Ralph Husack
*Assistant Examiner*—Janyce A. Bell
*Attorney, Agent, or Firm*—Johnston, Keil, Thompson & Shurtleff

[57] ABSTRACT

Reversibly moisture-vapor-absorptive sheet materials and a process for their manufacture in which water-soluble polymers of vinyl ethers are combined with base materials and crosslinked thereon.

9 Claims, No Drawings

REVERSIBLE MOISTURE-VAPOR-ABSORPTIVE SHEET STRUCTURES AND PROCESS

This invention relates to reversibly moisture-vapor-absorptive sheet materials such as artificial leather and clothing materials and to a process for their manufacture.

It is known to produce moisture-vapor-absorptive sheet materials by applying carboxyl-containing polymers to base materials and crosslinking them thereon. The resulting structures, for example artificial leathers or clothing materials, show good moisture absorption but this may be impaired by the action of heavy metal salts. Furthermore, such structures tend to delaminate.

It is an object of the present invention to provide synthetic moisture-vapor-absorptive sheet materials which do not suffer from the drawbacks of the prior art structures. Thus the invention relates to a reversibly moisture-vapor-absorptive sheet material consisting of a base material containing crosslinked vinyl ether polymer which is embedded in said base material and is water-soluble in the uncrosslinked state.

Another object is the manufacture of reversibly moisture-vapor-absorptive sheet materials by combining base material with water-soluble vinyl ether polymers and crosslinking the latter on said base material.

Suitable base materials are web structures which are preferably premeable to gases. Particularly suitable structures are web structures formed from fibers of organic or inorganic origin, e.g. non-woven webs, woven or knitted fabrics, felts and close-mesh nets. Foamed web structures having a major proportion of open cells are also suitable.

It is advantageous to impregnate the base materials, particularly non-woven webs and felts, with high molecular weight substances which are non-swellable or only slightly swellable in water, before the polyvinyl ethers are applied to said materials. Suitable substances for such impregnation are all natural and synthetic binders provided they do not hinder the passage of gases through the web structure in the amounts applied.

In the present invention, water-soluble vinyl ether polymers are used for combination with said base materials. Suitable polymers are homo- and/or co-polymers of vinyl ethers. Examples of suitable polymers or copolymers are those of the vinyl ethers of methanol, methyl glycol, methyl diglycol, tetrahydrofurfuryl alcohol and 3-oxytetrahydrofuran. Suitable comonomers include vinyl ethers which, when polymerized alone, produce polyvinyl ethers which are water-insoluble, e.g. ethyl, propyl and high alkyl ethers or alkylene vinyl ethers such as allyl vinyl ethers or cycloaliphatic vinyl ethers such as cyclohexyl or dialkyl ethers, when used in such proportions that the copolymers are soluble in water.

The use of aqueous solutions of homo- and/or copolymers of vinyl ethers for combination with the base materials naturally has the well-known advantages over the use of solutions in organic solvents. However, the main additional advantage in using aqueous solutions of homo- and/or co-polymers of vinyl ethers is that these latter compounds become insoluble at elevated temperatures and flocculate out of the aqueous solution. The commencement of flocculation is characterized by clouding of the aqueous solution, the temperature at which this occurs being known as the cloud point (see Encyclopedia of Polymer Science and Technology, Vol. XIV). The cloud point is essentially dependent on the constitution of the polyvinyl ether and also on the concentration of the aqueous solution and on the additives used. Examples of cloud points are approx. 33°C for polyvinyl methyl ether, 60°C for polyvinyl methyl glycol ether, about 75°C for polyvinyl methyl diglycol ether and 18°C for a copolymer of 80% molar of vinyl methyl ether and 20% molar of vinyl ethyl ether.

In our process, the base materials may be combined with the vinyl ether polymers by conventional methods, e.g. by rolling and extruding techniques and preferably by even application of the polymer to the base material from an aqueous solution, for example by dipping, knife-coating, pouring, padding and other impregnating techniques. Thus by "combination" of the polymers with the base material we mean distribution of the polymer in the base material or embedding of the base material in the polymer.

By heating the base material impregnated with the aqueous polyvinyl ether solution above the cloud point, the polyvinyl ether is caused to flocculate and thus becomes fixed in the base material. Further operations such as drying cannot cause it to migrate to the surface with the solvent. The normally inevitable appearance of accumulated solids at the surface and thus the separation of delamination which normally occurs, after drying, in the case of base materials impregnated with solutions is obviated in the process of the invention and there is obtained a structure which is homogeneous throughout its cross-section.

Although the vinyl ether polymers may be dissolved in organic solvents and combined with the base materials in this form, such a method has no added advantages over application from aqueous solution.

The vinyl ether polymers combined with the base material are then crosslinked. By crosslinking we mean the joining of the main valencies of the polymer chains to form three-dimensional structures by radical combination (see B. Vollmert "Grundrisse der makromolekularen Chemie" or Houben-Weyl "Methoden der organischen Chemie", Vol. XIV/2 "Makromolekulare Stoffe"). The crosslinking destroys in known manner the solubility of the high molecular weight compounds except for residues of low molecular weight portions. However, the crosslinked products remain swellable in the solvents for the uncrosslinked substance. In the process of the invention, it is preferred to effect crosslinking to such an extent that when the structure is exhaustively extracted with water at 23°C, not more than 15% of the vinyl ether polymers which were water-soluble before crosslinking is dissolved out of the crosslinked gel.

In a particularly advantageous embodiment, the base materials are impregnated with aqueous solutions of polyvinyl ethers already containing the crosslinking catalyst, e.g. in the form of peroxide. When this aqueous polyvinyl ether solution is heated, the polymer is precipitated onto the fibrous base material and at the same time crosslinked. After drying, for example at room temperature but preferably at an elevated temperature of, say, 80° – 120°C, there is obtained a structure having a high moisture vapor absorptive capacity and remaining soft, flexible and tackfree even when completely free from water.

The web structures, preferably fibrous web structures and in particular non-woven webs, which are used as base materials for the polyvinyl ether may be pre-impregnated prior to application of the polyvinyl ethers in order to influence the mechanical properties of the finished moisture-vapor-absorptive web structure, for example its strength, toughness, hardness and elasticity. The substances used for this purpose are conventional substances such as natural or synthetic high molecular weight materials subject to low or very little modification of their properties by water, e.g. rubbers, polymers of vinyl and acrylic compounds with other copolymerizable compounds, urea or melamine or phenol resins, epoxide resins and polyurethane, either alone or in various combinations. In view of the great variety of embodiments of the process of the invention, it is only possible to state, in a general manner, that the pretreatment should be carried out in such a manner that the pre-impregnated base materials remain capable of allowing the passage of gases and liquids therethrough.

The concentration of the preferably aqueous solution of vinyl ether polymer is dependent on the desired rate of application onto the base material and on the viscosity of the solution. The concentration of the solution is generally between 1 and 50% and preferably between 10 and 30% by weight. The rate of application is governed by the desired moisture-vapor-absorptivity of the web structure and ranges from 10 to 70% and preferably from 20 to 60% by weight of polymer based on the final weight of the impregnated base material, as measured after drying in air at 110°C. If necessary, the rate of application may be increased by impregnating a number of times using, for example, solutions of low solids content.

The base materials impregnated with the aqueous solutions of polyvinyl ether already containing crosslinking catalysts are heated to a temperature of at least 5° above the cloud point of the polyvinyl ether solution used and are preferably also dried above this temperature. Crosslinking is then effected at from 80° to 160°C. advantageously in a medium containing less than 2% v/v of molecular oxygen.

Flocculation of the polymer onto the base material, drying and crosslinking may form separate operations. It is particularly advantageous to effect flocculation of the polyvinyl ethers by passing hot gases or vapors containing not more than 2% v/v of oxygen, preferably steam, e.g. saturated steam, at atmospheric pressure or at superatmospheric pressure, possibly superheated steam, to cause flocculation, i.e. fixation, of the polyvinyl ether and simultaneously crosslinking thereof, so that it is then only necessary to remove the residue of solvent remaining as swelling agent. Alternatively, flocculation and crosslinking may be carried out in appropriately heated liquid media, e.g. in water heated at 100°C.

Another method of effecting crosslinking is to treat the base material impregnated with polyvinyl ethers with high-energy radiation in known manner.

It will be appreciated that other additives or so-called cocrosslinkers may be added to the solutions of polyvinyl ether, for example sulfur and di- or poly-functional monomers such as triallyl cyanurate, ethylene glycol diacrylate and ethylene glycol dimethacrylate and diene-containing polymers such as natural or synthetic latices. It is also possible to add stabilizers to the aqueous polyvinyl ether solutions, e.g. known antioxidants, flame-proofing agents, fillers and other dispersions or solutions of natural or synthetic high molecular weight substances.

It may also be advantageous to effect stabilization after crosslinking, for example by treating the crosslinked web structure with solutions or dispersions or slurries of suitable antioxidants based on phenol, aldehyde, amine, phosphite, mercaptan, ammonium sulfide, ammonium polysulfide or thio-urea.

The resulting structures may also be treated to attain other properties, for example to increase or reduce the water-vapor absorptivity, the stiffness and elasticity. Further impregnation with, say, dyes, fats, salts, etc. may be carried out before or after drying. It is advantageous to effect post-impregnation with aqueous solutions or dispersions of compounds having large anions such as oxaryls, arylcarboxylic and arylsulfonic acids or salts thereof, aliphatic di- or poly-carboxylic or sulfonic acids having molecular weights of more than 100 or salts thereof and acid dyes having large anions.

Finally, the web structures may be surface-ground, roughened, varnished or embossed by known methods.

It is a particular advantage of the process of the invention or of the web structures produced thereby that the vinyl ether polymers may be evenly distributed in the base material from aqueous solution in a highly economical manner and that this even distribution over the entire cross-section remains after further operations, particularly drying. This makes the mechanical properties of the composite structures particularly advantageous. Since sandwiching is virtually completely avoided, these structures have a pleasant soft and full handle. Their reversible absorption of moisture vapor is similar to that of natural textile filaments or natural leather without giving a feeling of wetness. Thus these web structures are particularly suitable for use as synthetic leathers for clothing purposes, e.g. for shoes and outerwear.

EXAMPLE 1

A non-needle-punched web weighing 200 g/m² and made of polycaprolactam fibers of 1.7 dtex and a staple length of 60 mm is placed between gauzes of polycaprolactam monofilaments and thus impregnated with an aqueous dispersion consisting of 14 parts by weight of a 50% synthetic latex based on 6:4 butadiene/styrene,
86 parts by weight of water,
0.1 part by weight of aluminum sulfate,
0.25 part by weight of an adduct of ethylene oxide and sperm oil alcohol,
followed by squeezing between rollers to give a wet pickup of 400% by weight. The gauzes are removed and the impregnated material is coagulated with steam at 100°C over 4 minutes, whereupon the structure is dried in air at 130°C. There is obtained a nonwoven web weighing 256 g/m² and readily permeable to air and water vapor.

The thus pre-impregnated web is then impregnated with a solution of
23 parts by weight of polyvinyl methyl ether (K value 45) in
77 parts by weight water, to which
2.3 parts by weight of a 50% slurry of dibenzoyl peroxide in dibutyl phthalate has been homogeneously added by stirring
at room temperature and then squeezed between rollers coated with polytetrafluoroethylene to give a wet pickup of 400%. The web is then steamed with saturated steam at 100°C for 20 minutes, this operation being followed immediately by removal of excess water by roller squeezing of the web while it still has a temperature of about 90°C, after which it is passed into a solution of 0.5 part by weight of ammonium sulfide,
5 parts by weight of morpholine and
94.5 parts by weight of water and is left in this solution at room temperature. After drying in air at 110°C, there is obtained a soft flexible structure weighing 500 g/m².

The web is conditioned for 48 hours at a relative humidity of 50% and a temperature of 23°C and then stored for 24 hours in an atmosphere of 100% relative humidity (r.h.) and a temperature of 23°C and then shows a weight increase of 14%. The soft and dry handle remains unspoiled. This is followed by storage for 2 hours in an atmosphere of 50% r.h. at 23°C, after which period the loss of weight is measured to be 12.6%, i.e. an excess weight of only 1.4% remains over the material conditioned for 48 hours at 50% r.h. and 23°C.

EXAMPLE 2

As in Example 1, a web is impregnated with synthetic latex, coagulated and dried. The thus pre-impregnated web is impregnated at room temperature with a solution of 25 parts by weight of polyvinyl methyl glycol ether (K value 34) in
75 parts by weight of water, into which
2 parts by weight of a 50% slurry of dibenzoyl peroxide in dibutyl phthalate and
0.1 part by weight of pentaerythrityl tetrakis-[3-(3,5-di-t-butyl-4-hydroxyphenyl)propionate]

have been homogeneously stirred, whereupon the web is squeezed to give a wet pickup of 400% and is then treated with boiling water at 100°C for 95 minutes. After drying in air at 110°C, there is obtained a soft firm structure weighing 500 g/m².

After conditioning for 48 hours at 50% r.h. and 23°C followed by storage for 24 hours at 100% r.h. and 23°C there is obtained a weight increase of 29%, the dry soft handle remaining unspoiled.

EXAMPLE 3

A non-needle-punched web weighing 160 g/m² and made from 60% w/w of polycaprolactam fibers of 1.7 dtex and a stable length of 60 mm and 40% w/w of polyterephthalate fibers of 3.0 dtex and a staple length of 30 mm is impregnated with an aqueous dispersion consisting of 10 parts by weight of a 50% emulsion polymer of n-butyl acrylate,
90 parts by weight of water,
0.2 part by weight of aluminum sulfate and
0.3 part by weight of an adduct of polyethylene oxide and sperm oil alcohol, whereupon the web is squeezed to give a wet pickup of 500% by weight, coagulation then being effected in saturated steam at 100°C over 3 minutes. After drying at 110°C, there is obtained a non-woven web weighing 205 g/m² and permeable to air.

This prebonded non-woven web is impregnated at room temperature with a mixture consisting of 20 parts by weight of polyvinyl methyl ether (K value 45),
4 parts by weight of a 50% synthetic latex based on 7:3 butadiene/acrylonitrile,
2 parts by weight of a 50% paste of dibenzoyl peroxide in dibutyl phthalate,
0.1 part by weight of sulfur,
0.002 part by weight of hydroquinone and
71.9 parts by weight of water, squeezing being effected to give a wet pickup of 500%. The web is then treated with saturated steam at 100°C for 20 minutes and then in a bath of 10 parts by weight of the condensation product of phenolic and cresolsulfonic acids with formaldehyde,
1.0 part by weight of dodecyl sulfonate and
89 parts by weight of water at room temperature for 30 minutes, followed by drying in air at 105°C. There is obtained a soft structure having a fully resilient hand and a weight of 470 g/m². The weight increase after storage for 24 hours at 100% r.h. and 23°C is 31% over the material preconditioned for 48 hours in an atmosphere of 50% r.h. and 23°C.

EXAMPLE 4

The web base materials listed in the following Table, of which some have been pre-impregnated with synthetic rubber, are impregnated at room temperature with a mixture consisting of 250 parts by weight of polyvinyl methyl ether (K value 50), 25 parts by weight of a 50% paste of dibenzoyl peroxide in dibutyl phthalate,
12.5 parts by weight of ethylene glycol diacrylate,
0.25 part by weight of hydroquinone,
50 parts by weight of a 50% synthetic latex based on 1:8 butadiene/styrene and
900 parts by weight of water followed by squeezing and crosslinking with saturated steam at 100°C for 18 minutes. It is then treated at room temperature for 20 minutes in a bath of
5 parts by weight of morpholine,
1 part by weight of thiourea and
94 parts by weight of water.

In all cases there is obtained a structure having a soft resilient hand and the following properties:

| Base material Fiber | Type of bonding | Pre-impregnated with 10% synthetic rubber | Proportion of polyvinyl ether in web structure (% w/w) | Moisture-vapor-absorptivity 50–100% r.h. at 23°C |
|---|---|---|---|---|
| 1:1:1 cellulose/polyester/nylon 6 | needle-punched | yes | 56.5 | 19.0% |
| 1:1:1 cellulose/polyester/nylon 6 | " | yes | 37.5 | 16.5% |
| 6:4 nylon 6/polyester | " | yes | 44.5 | 17.1% |
| 6:4 nylon 6/polyester | " | yes | 29.8 | 11.7% |
| cotton | woven | no | 41.2 | 17.5% |
| cotton | knitted | no | 61.5 | 26.0% |

-continued

| Fiber | Base material | Type of bonding | Pre-impregnated with 10% synthetic rubber | Proportion of polyvinyl ether in web structure (% w/w) | Moisture-vapor-absorptivity 50–100% r.h. at 23°C |
|---|---|---|---|---|---|
| polyester | | " | no | 44.4 | 20.1% |
| nylon 6 | | woven | no | 50.5 | 21.2% |

We claim:

1. A process for the manufacture of reversibly moisture-vapor-absorptive sheet material which comprises:
   a. applying an aqueous solution of a water-soluble vinyl ether polymer to a base material which is gas permeable; whereby said base material is impregnated with said aqueous solution;
   b. heating said impregnated base material sufficiently to cause said water soluble vinyl ether polymer to precipitate from said solution whereby said polymer is fixed in said base material;
   c. cross-linking said vinyl ether polymer; and
   d. drying said sheet material, the amount of water soluble vinyl ether polymer applied to said base in a) being sufficient to produce a final sheet material containing from 10 to 70% by weight of said polymer.

2. A process as set forth in claim 1 wherein said gas permeable base material has a web structure and is formed from organic or inorganic fibers.

3. A process as set forth in claim 1 wherein cross-linking of said vinyl ether polymer is affected by applying high energy radiation to said base material.

4. A process as set forth in claim 1 wherein the final web structure contains from 20 to 60% by weight of said vinyl ether polymer.

5. A process as set forth in claim 1 wherein said flocculation and cross-linking steps are carried out in hot water.

6. Moisture-vapor-absorptive sheet material prepared by the process of claim 1.

7. A process as set forth in claim 1 wherein said aqueous solution of ether polymer contains a cross-linking catalyst and whereby said precipitation step and said cross-linking step occur at the same time.

8. A process as set forth in claim 7 wherein said cross-linking catalyst is a peroxide.

9. A process as set forth in claim 7 wherein said base material impregnated with an aqueous solution of vinyl ether polymer containing a cross-linking catalyst is heated to a temperature of at least 5°C above the cloud point of the vinyl ether solution.

* * * * *